US006149362A

United States Patent [19]

Berrier et al.

[11] Patent Number: 6,149,362

[45] Date of Patent: Nov. 21, 2000

[54] DUNNAGE AIR BAG

[75] Inventors: Walter Gene Berrier; John Leslie Harrington, both of Sheridan, Ark.; Phillip S. Massey, Mt. Pleasant, Tenn.

[73] Assignee: Illinois Tool Works Inc., Glenview, Ill.

[21] Appl. No.: 09/392,795

[22] Filed: Sep. 9, 1999

Related U.S. Application Data

[62] Division of application No. 08/994,359, Dec. 19, 1997.

[51] Int. Cl.[7] ..... B60P 7/16

[52] U.S. Cl. ..... 410/119; 410/125

[58] Field of Search ..... 410/117, 118, 410/119, 125, 122, 155; 206/522; 383/25, 109, 113; 428/35.2

[56] References Cited

U.S. PATENT DOCUMENTS

| | | | |
|---|---|---|---|
| 3,199,689 | 8/1965 | Feldkamp | 410/119 |
| 3,808,981 | 5/1974 | Shaw | 410/119 |
| 3,868,026 | 2/1975 | Baxter | 410/119 |
| 3,944,084 | 3/1976 | Reeves | 410/119 |
| 3,960,281 | 6/1976 | Reeves | 410/119 |
| 4,040,526 | 8/1977 | Baxter et al. | 410/119 |
| 4,136,788 | 1/1979 | Robbins | 410/119 |
| 5,788,438 | 8/1998 | Goshorn et al. | 410/119 |
| 5,868,534 | 2/1999 | Goshorn et al. | 410/119 |
| 5,908,275 | 6/1999 | Howlett, Jr. et al. | 410/119 |

FOREIGN PATENT DOCUMENTS

| | | | |
|---|---|---|---|
| 599184 | 3/1948 | United Kingdom | 428/35.2 |

*Primary Examiner*—Stephen T. Gordon
*Attorney, Agent, or Firm*—Schwartz & Weinrieb

[57] ABSTRACT

An inflatable dunnage air bag comprises a multi-layered paper bag and an inflatable bladder disposed within the multi-layered paper bag such that two sets of paper plies are disposed upon opposite sides of the inflatable bladder. The multi-layered paper bag has at least one flap member extending outwardly from one set of paper plies and is adapted to extend from a first side of the inflatable bladder and be folded over and secured upon the other set of paper plies so as to be secured at a location disposed upon the other or second side of the inflatable bladder. An inflation valve is fixedly secured to the first side of the inflatable bladder so as to facilitate inflation thereof, the inflation valve thereby being disposed remote from the location at which at least one flap member is secured so as not to present additional weakening forces or stresses within the already high-stress flap securing region. Enhanced burst strength values are achieved with the inflatable dunnage air bag having such aforenoted interrelated structure.

22 Claims, 5 Drawing Sheets

DUNNAGE AIR BAG

CROSS-REFERENCE TO RELATED PATENT APPLICATIONS

This patent application is a Divisional patent application of prior U.S. patent application Ser. No. 08/994,359, which was filed on Dec. 19, 1997.

This patent application is related to U.S. patent application Ser. No. 08/654,307, filed on May 28, 1996, issued on Aug. 4, 1998 as U.S. Pat. No. 5,788,438 and entitled INFLATABLE COMBINATION CARGO PACKING BAG, and U.S. patent application Ser. No. 08/899,582, filed on Jul. 24, 1997, issued on Jun. 1, 1999 as U.S. Pat. No. 5,908,275, and entitled BAG-IN-BAG COMBINATION DUNNAGE AIRBAG.

FIELD OF THE INVENTION

The present invention relates generally to dunnage air bags for use in connection with the shipment of freight or cargo by means of truck, rail, aircraft, ship, and the like, and more particularly to an improved dunnage air bag which exhibits improved burst strength characteristics.

BACKGROUND OF THE INVENTION

Inflatable, disposable dunnage bags comprise a relatively inexpensive and easily useable means for stabilizing cargo or freight disposed within cargo holds, cargo bays, cargo containers, box-cars, trailers, or the like, of aircraft, trucks, trains, ships, or other transportation vehicles, so as to effectively prevent the goods from being damaged which is Likely to occur when the goods are not otherwise secured or tied down within the cargo hold or the like since the goods are subjected to shifting movements within the cargo hold or bay in response to movements of the particular transportation vehicle during shipping or transport. As is well known and conventionally practiced in the transportation industry, and as is exemplified by FIG. 1, inflatable dunnage bags 10 are placed between individual, adjacent cargo items or pieces 12, or between the individual cargo pieces and the side walls 14 of the vehicle within which the cargo hold 16 is defined, in an initially deflated condition and are then subsequently inflated with, for example, compressed air to a predetermined pressure value which is of course below the bursting pressure limit of the bag. Most bags which are conventionally employed are specifically constructed so as to be capable of withstanding bursting pressure values which are within the range of 12–30 psig. As is also illustrated, sheet or board-type buffer members 18 are also sometimes placed between the dunnage bags 10 and the cargo loads 12. One type or embodiment of a conventional dunnage bag is disclosed within U.S. Pat. No. 4,136,788 which issued to Robbins on Jan. 30, 1979.

Another conventional dunnage bag similar to that of Robbins is illustrated at 10 in FIG. 2 and is seen to comprise a sealed inner plastic bladder or bag 22 which is fabricated, for example, from polyethylene, and an outer multi-layered or multi-walled paper bag 24 that serves to protect the inner inflatable bag or bladder 22 as well as to increase the burst strength characteristics of the dunnage bag 10. In the exemplary dunnage bag 10 illustrated in FIG. 2, the outer multi-walled or multi-layered paper bag 24 is seen to comprise, for example, four paper plies or layers 1,2,3,4.

Manufacture of such conventional inflatable dunnage bags typically comprises folding a predetermined length of multi-layered kraft paper onto itself and about a longitudinal axis thereof such that the edges thereof can form an overlapping longitudinal seam, not shown, which extends along the centerline of the multi-walled or multi-layered paper bag 24, the result being a multi-walled or multi-layered paper tube having opposite open ends. The sealed plastic bladder 22 is then inserted into the paper tube through one of the open ends thereof, and the tube ends are then folded over onto themselves in a predetermined manner and are subsequently glued closed thereby forming the completed dunnage bag 10.

In accordance with the particular exemplary mode of folding and sealing each end of the multi-walled or multi-layered paper bag 24, and with only one end of the multi-walled or multi-layered paper bag 24 being illustrated in FIG. 2, it is seen that each paper ply or layer 1,2,3,4 of the multi-walled or multi-layered paper bag 24 has a first end respectively denoted by the reference characters 1A,2A,3A, 4A, and a second opposite end respectively denoted by the reference characters 1B,2B,3B,4B. The ends 1B,2B, and 3B of the paper plies or layers 1,2,3 are freely disposed atop each other, while the end 1A of paper ply or layer 1 is freely disposed or inserted beneath end 1B. Ends 2A,3A, and 4A of paper plies or layers 2,3, and 4 are also disposed atop each other, however, it is seen that end 2A of paper ply 2 is fixedly secured to end 3B of paper ply 3 by means of a first glue bead 26, end 3A of paper ply 3 is fixedly secured to end 2A of paper ply 2 by means of a second glue bead 28, and end 4A of paper ply 4 is fixedly secured to end 3A of paper ply 3 by means of a third glue bead 30. The outer surface of paper ply 4 is also conventionally coated with a suitable heat-sealable plastic, such as, for example, polyethylene, in order to provide the dunnage bag 10 with a predetermined amount of water-resistance, and accordingly, end 4B of paper ply 4 is disposed atop end 4A of paper ply 4 and the ends 4A and 4B may then be heat-sealed to each other by means of well-known heat-sealing techniques.

In order to inflate the interior portion of the dunnage bag 10 with a suitable compressed gas, such as, for example, air, from an external compressed air source, not shown, when it is desired to inflate the dunnage bag 10, that is, for example, for cargo securing purposes, an inflation valve 20 is provided and is heat-sealed upon the upper wall 22B of the inflatable bladder 22 such that the valve 20 is in fluidic communication with the interior of the bladder 22. It is also seen that the inflation valve 20 extends or projects through respective holes 1C,2C,3C, and 4C provided within the ends 1B,2B,3B, and 4B of the paper plies or layers 1,2,3,4 of the multi-walled or multi-layered paper bag 24 whereby the inflation valve 20 is rendered externally accessible.

It is well-known in the industry, however, that the region of an inflatable, multi-ply or multi-layered kraft paper dunnage bag, such as that exemplified and shown in FIGS. 1 and 2 at 10, which comprises the glued flap region at which, for example, the ends 2A,3A, and 4A of the paper plies 2,3, and 4 are glued and sealed together and to the ends 3B and 4B of the paper plies 3 and 4, respectively, comprises a high-stress region at which stresses, forces, and internal pressures attendant the inflation of the dunnage bag 10 are concentrated. An important factor to be considered or which is required to be addressed in connection with such multi-ply or multi-layered kraft paper dunnage bags resides in the tendency of the multi-layered or multi-ply flaps to unfold or separate not only from each other but also as an entity from the main portions or sides of the bags. The structural integrity of such region determines, in part, the burst strength of the bag 10.

It is also noted that such multi-ply or multi-layered kraft paper dunnage bags, such as that shown and exemplified in FIGS. 1 and 2 at 10, differ radically from what is known in the industry as abrasion-resistant air bags as exemplified or disclosed within U.S. Pat. No. 4,591,519 which issued to Liebel on May 27, 1986. Air bags such as those disclosed within the noted patent are used in connection with relatively light weight or low-pressure applications, such as, for example, those applications requiring working or inflation pressures of 1–3 psi, and it is seen that such air bags are constituted or constructed from first and second sheets 16 and 24 of two-ply laminated paperboard. Such paperboard is quite stiff or rigid and in effect self-sustaining whereby the air bags may be able to stand by themselves without sagging even prior to inflation of the same and disposition between cargo loads. The folded side and end sections 18 and 26 therefore do not present the same stress, force, and internal pressure characteristics or factors which are encountered in connection with the folded flaps of a multi-layered or multi-ply kraft paper bag as has been illustrated in FIGS. 1 and 2 at 10.

Another factor which determines or affects the burst strength characteristics of the dunnage bag 10 is the provision of the inflation valve 20, and more particularly, its relative location with respect to the glued flap region. The holes 1C,2C,3C, and 4C respectively defined within the paper plies 1,2,3, and 4 of the multi-layered or multi-ply paper bag 24 comprise weakened regions of the multi-layered or multi-ply bag 24. The reason for this is that the burst strength or structural integrity characteristics of the multi-layered or multi-ply bag 24 are derived from the paper plies or layers 1, 2,3,4 per se. Consequently, the provision of the holes 1C,2C, 3C, and 4C within the respective paper plies or layers 1,2,3, and 4 define discontinuities within the paper plies or layers 1,2,3, and 4 which thereby results in a decrease in the over-all structural integrity or burst strength characteristics of the dunnage bag 10.

When this factor comprising the location of the holes 1C,2C,3C, and 4C of the paper plies 1,2,3, and 4 within the region or vicinity of the glued flap region is considered in connection with the aforenoted factor that the glued flap region already comprises a high-stress region, the entire region, area, or vicinity is compromised to a predetermined extent. This is illustrated within FIG. 3 wherein the results of burst strength testing is schematically illustrated. In particular, it is noted that when the dunnage bag 10 is subjected to bursting, the bag 10 bursts along lines or locations 32 and 34 which intersect each other and pass directly through the hole regions of the inflation valve 20.

In an attempt to therefore improve the burst strength and structural integrity characteristics of the dunnage bags, it has been proposed by the present inventors to increase the relative size of, for example, the ends 2A,3A, and 4A of the papers plies or layers 2,3, and 4 of the multi-layered or multi-walled outer bag 24 in order to in effect increase the relative size of the folded and glued flap region comprising the ends 2A,3A, and 4A of the paper plies 2,3, and 4 when they are glued to each other and to the ends 3B and 4B of the paper plies 3 and 4 by means of the glue beads 26,28, and 30, as well as the aforenoted heat-sealed polyethylene coating disposed upon the external surface of the paper ply 4. However, test data has demonstrated that in view of tucked-in nature of the paper ply ends 2A,3A, and 4A with respect to or beneath the external paper ply end 4B of the bag 10, and in view of the additional fact that the glue beads 26,28, and 30 comprise cold glue beads, no significant improvement in the burst strength characteristics or structural integrity of the bag 10 was achieved. In addition, the provision of such a folded and glued flap region which is accordingly increased in size presents a logistics or location problem in connection with the inflation valve 20.

In particular, the newly proposed folded and glued flap region would extend backwardly along the surfaces of paper ply ends 3B and 4B so as to interfere with the presence or disposition of inflation valve 20. It has therefore been additionally proposed to relocate or move the inflation valve 20 in the direction backwardly or away from the folded and glued flap region, however, this likewise presents a problem for operator personnel when it is desired to inflate the dunnage bag 10. This can be more fully appreciated if reference is again made to FIG. 1. If the inflation valve 20 was moved backwardly away from the folded and glued flap region, it would then be located more internally between adjacent cargo loads 12 or between the buffer members 18 and therefore would not be as readily accessible from an external vantage point by operator personnel whereby the inflation process would be rendered substantially more difficult to perform.

Accordingly, there is a need in the dunnage air bag art to provide a new and improved dunnage air bag which in fact exhibits improved or enhanced burst strength characteristics and wherein the inflation valve thereof is still readily externally accessible to operator personnel so as to maintain the dunnage air bag inflation process relatively simple.

OBJECTS OF THE INVENTION

Accordingly, it is an object of the present invention to provide a new and improved dunnage air bag.

Another object of the present invention is to provide a new and improved dunnage air bag which overcomes the various disadvantages and drawbacks characteristic of conventional dunnage air bags.

A further object of the present invention is to provide a new and improved dunnage air bag which exhibits improved or enhanced structural integrity and burst strength characteristics while readily preserving the external accessibility of the inflation valve to operator personnel.

SUMMARY OF THE INVENTION

The foregoing and other objects of the present invention are achieved through the provision of a dunnage air bag wherein the end flap members, comprising a plurality of paper plies or layers, are folded over upon themselves and onto, in effect, a first outer surface portion or side of the composite dunnage air bag, and wherein further, the inflation valve for the inflatable dunnage air bag is inserted or mounted with a second opposite outer surface portion or side of the composite dunnage air bag. In this manner, the inflation valve and the holes, operatively associated therewith and defined within the various paper plies or layers of the dunnage air bag, are in effect located at a site which is remote from the high stress folded and glued flap region.

As a result of the foregoing structure constructed in accordance with the principles and teachings of the present invention, the improved dunnage air bags exhibit enhanced burst strength characteristics. Alternatively, as a result of such enhanced burst strength characteristics, one or more paper plies of the dunnage air bag may be eliminated such that currently acceptable or conventional burst strength values or levels may still be achieved. This processing or manufacturing technique therefore provides significant economic savings in connection with the manufacture or fabrication of dunnage air bags.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 4:
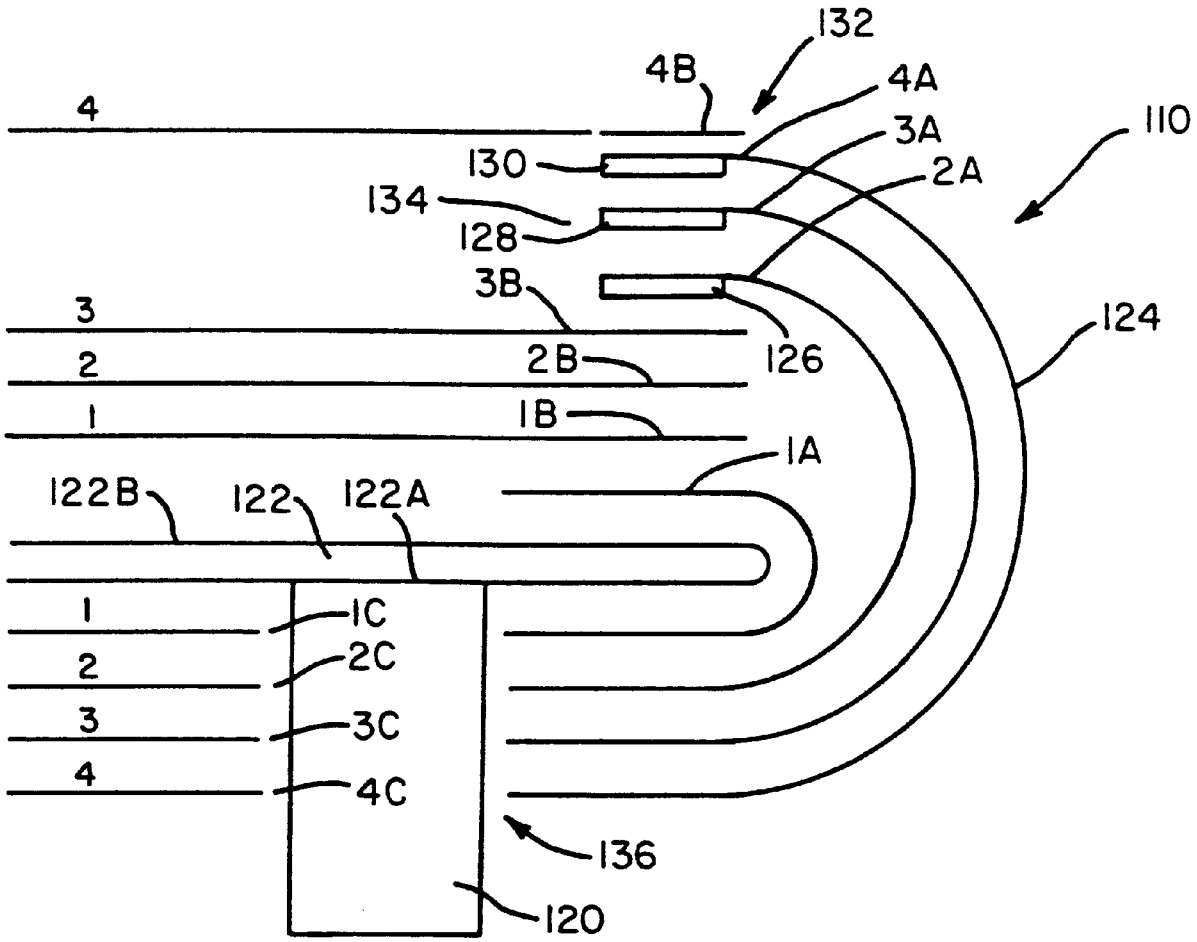
FIG. 4 is a view similar to that of FIG. 2 showing, however, a first embodiment of a new and improved dunnage air bag constructed in accordance with the teachings and principles of the present invention.

Referring again to the drawings, and more particularly to FIG. 4 thereof, a first embodiment of a new and improved dunnage air bag constructed in accordance with the principles and teachings of the present invention is illustrated and is generally indicated by the reference character 110. It is to be noted that in connection with the detailed description of the dunnage air bag 110 that the bag 110 is for the most part quite similar to the dunnage bag 10 illustrated in FIG. 2, and consequently, all features, structural components, and the like which are similar to those of the conventional dunnage air bag 10 will be denoted by similar reference characters except that the reference characters will be within the 100 series.

Accordingly, it is seen that the new and improved dunnage air bag 110 constructed in accordance with the teachings and principles of the present invention comprises an inner inflatable bladder 122 having upper and lower walls 122B and 122A, and the bladder 122 is disposed internally within a multi-layered or multi-walled outer paper bag 124 which, for example, comprises four plies or layers of paper 1,2,3, and 4, although it is of course possible that the dunnage bag 110 can comprise more than four plies and may, for example, comprise anywhere from two to eight paper plies. As was the case with the dunnage bag 10 illustrated in FIG. 1, the paper plies or layers 1,2,3, and 4 each have first end portions 1A,2A,3A, and 4A, and second end portions 1B,2B,3B, and 4B, respectively, and the first end portions 1A,2A,3A, and 4A are folded backwardly with respect to the second end portions 1B,2B,3B, and 4B so as to form a folded flap end structure generally indicated by the reference character 132.

Figure 1:
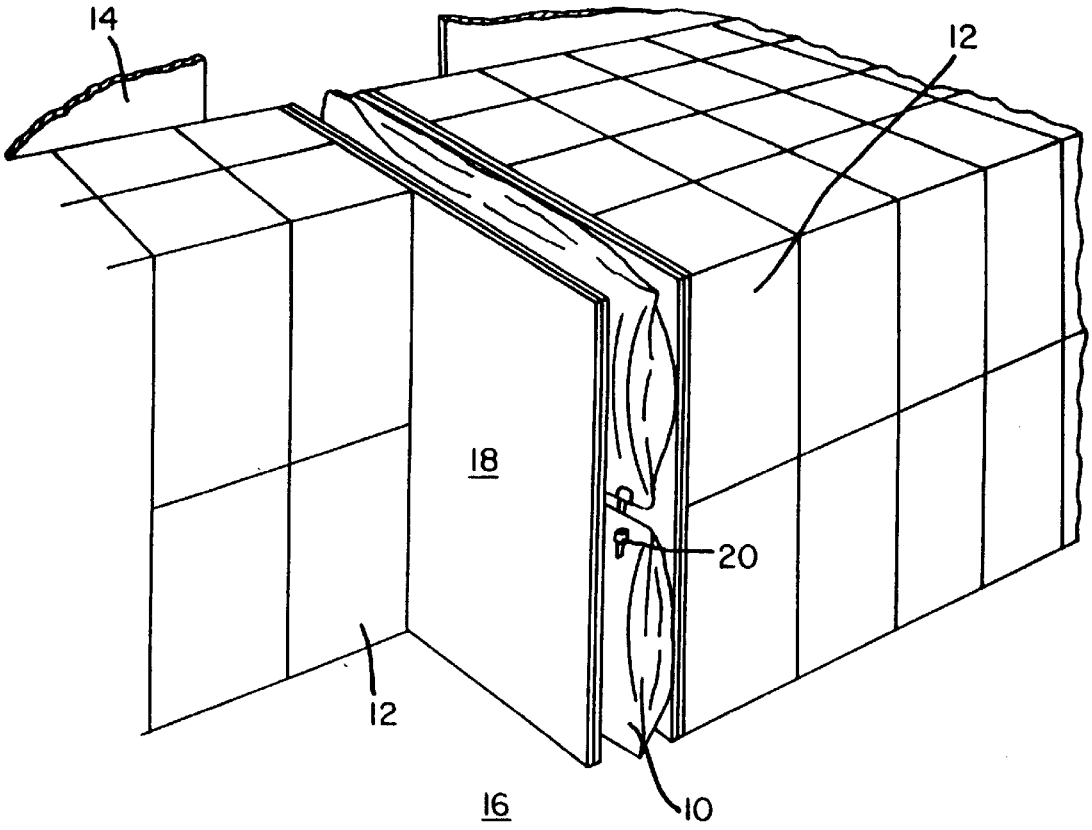
FIG. 1 PRIOR ART
FIG. 1 is a perspective view of cargo loads disposed within a cargo hold or cargo bay and wherein conventional dunnage air bags are being utilized between the cargo loads so as to stabilize the same during transit.

More particularly, as was the case in connection with the dunnage air bag 10 illustrated in FIG. 1, end portion 1A of paper ply 1 is folded and inserted between the upper wall 122B of the inflatable bladder 122 and the end portion 1B of the paper ply 1, and end portions 1B,2B, and 3B of the paper plies or layers 1,2, and 3 are disposed atop each other. On the other hand, end portion 2A of paper ply 2 is fixedly secured to end portion 3B of paper ply 3 by means of a first glue bead 126, end portion 3A of paper ply 3 is fixedly secured to end portion 2A of paper ply 2 by means of a second glue bead 128, and end portion 4A of paper ply 4 is fixedly secured to end portion 3A of paper ply 3 by means of a third glue bead 130. It is also appreciated that the end portions 2A,3A, and 4A of the paper plies 2,3, and 4 are inserted between end portion 3B of paper ply 3 and end portion 4B of paper ply 4. The external surface of paper ply 4 is coated with a suitable heat-sealable plastic material, such as, for example, polyethylene, so as to provide the dunnage bag 110 with a predetermined amount of water resistance, and the end portion 4B of paper ply 4 is then able to be fixedly secured to end portion 4A of paper ply 4 by means heat-sealing techniques performed in connection with the heat-sealable plastic material. Of course, other means or techniques may be employed in lieu of the use of the heat-sealable polyethylene in connection with the closure or sealing of the bag 110 whereby the polyethylene coating may be eliminated.

As has been noted hereinbefore, the region at which the folded and glued flap end structure 132 is formed comprises a high stress region generally indicated by the reference character 134. Consequently, in order to eliminate any additional or further stresses within such area or region 134, or considered alternatively, in order not to impress or develop any additional weakness within such region, the inflation valve 120 for the dunnage bag 110 has in effect been relocated from within the vicinity of the high stress flap end region 134, which is also disposed upon a first or upper side of the dunnage bag 110, to a location 136 which is remote from such high stress flap end region 134 and which is located upon a second or lower side of the dunnage bag 110.

Figure 5:
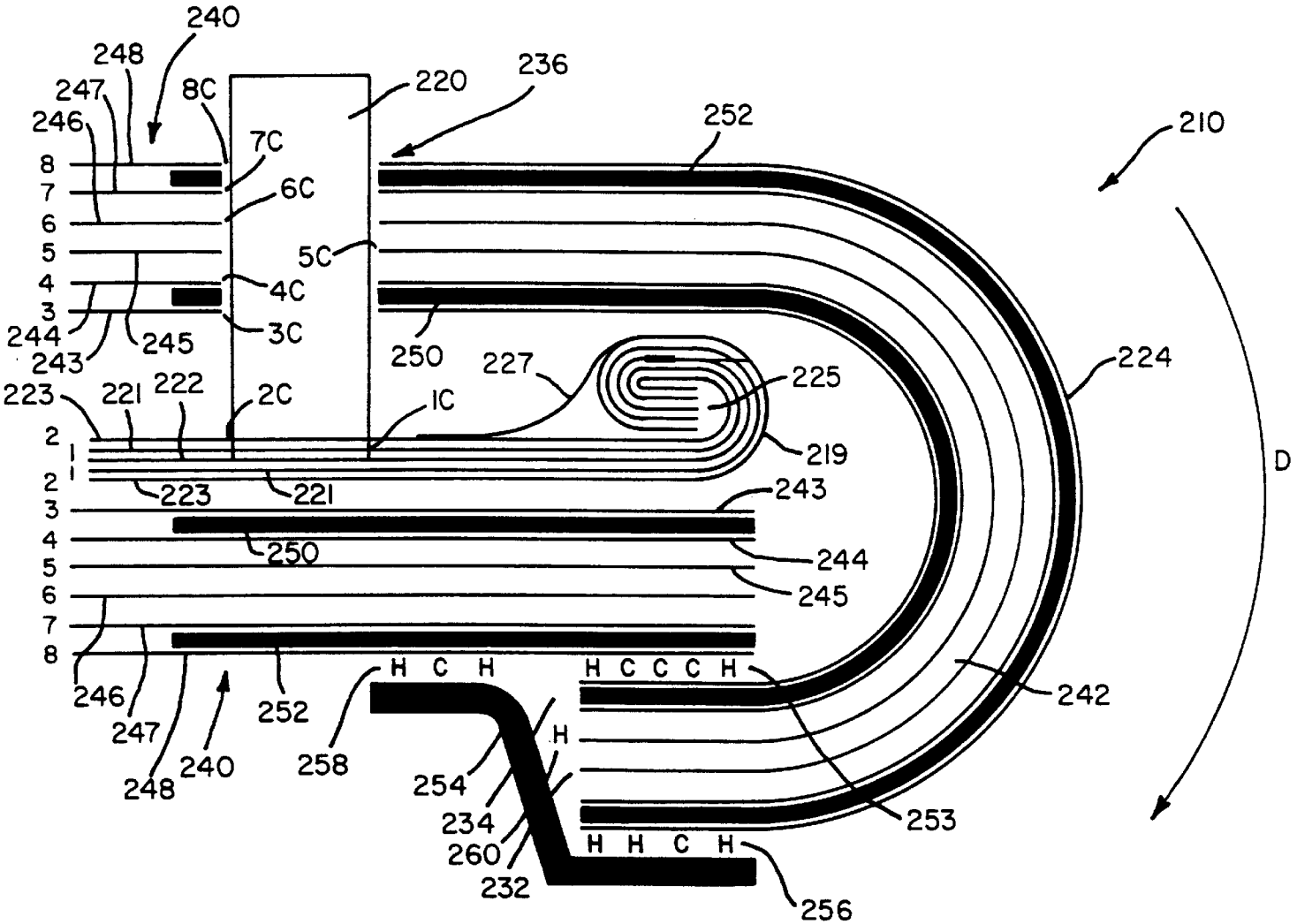
FIG. 5 is a view similar to that of FIG. 4 showing, however, a second embodiment of a new and improved dunnage air bag constructed in accordance with the principles and teachings of the present invention.

As was the case with the dunnage bag 10 illustrated in FIG. 1, the inflation valve 120 is fixedly mounted within, for example, the lower wall 122A of the inflatable bladder 122 so as to be fluidically connected to the interior of the bladder 122, and the paper plies or layers 1,2,3 and 4 are provided with suitable apertures 1C,2C,3C, and 4C through which the inflation valve 120 projects such that the inflation valve 120 is accessible external of the dunnage bag 110 whereby the dunnage bag 110 can be readily inflated. In view of the fact that the inflation valve 120 is located relatively remote from the folded and glued flap end structure 132 and the high stress region 134, the relatively weakened areas of the paper plies 1,2,3 and 4, as defined or determined by means of the holes or apertures 1C,2C,3C, and 4C provided therein, do not contribute further or additional weakening forces or stresses to the high stress region 134 whereby it has been determined that increased or enhanced burst strength characteristics are in fact exhibited by a dunnage bag having the structural makeup as illustrated in connection with the dunnage bag 110. It is also noted that the inflation valve 120 when disposed at its new location site 136 is still close enough to the folded and glued end of the dunnage bag 110 so as to be readily externally accessible to operator personnel when inflation of the dunnage bag 110 in connection with cargo loads is to be performed, With reference lastly being made to FIG. 5, it is to be appreciated that the principles and teachings of the present invention may be incorporated within dunnage air bags having structures different from that of the dunnage air bag 110 illustrated in FIG. 4. More particularly, the principles and teachings of the present invention may be adapted for, incorporated within, or applied to, for example, an eight-ply dunnage air bag which is illustrated in FIG. 5 and is generally indicated by the reference character 210, although, again, as has been noted hereinbefore, the particular number of paper plies comprising the dunnage bag may vary wherein the the dunnage bag may comprise, for example, anywhere from two to eight paper plies. It is to be noted that structural components of the dunnage air bag 210 which are similar to the dunnage air bags 10 and 110 of FIGS. 2 and 4, respectively, are denoted by similar reference characters except that the reference characters are within the 200 series. It is also to be noted that the eight-ply dunnage air bag 210 is similar to the eight-ply dunnage air bag 110 disclosed within FIG. 14 of the aforenoted U.S. patent application Ser. No. 08/899,582, filed on Jul. 24, 1997, and entitled BAG IN BAG COMBINATION DUNNAGE AIRBAG, the detailed description of which is hereby incorporated by reference.

More particularly, but briefly for illustrative purposes of the present invention, the dunnage air bag 210 is seen to comprise a first inner composite bag 219, and a second outer composite bag 224 within which the first inner composite bag 219 is encased or enveloped. The first inner composite bag 219 includes an inflatable bladder 222 and first and second paper plies 221 and 223 disposed upon both opposite surfaces or sides of the bladder 222, and the end portion of the first inner composite bag 219, comprising the inflatable bladder 222 and the two sets of inner and outer paper plies 221,223 and 221,223 is folded over upon itself so as to form a double fold end closure 225. The closure 225 is then secured in its folded state by means of, for example, a suitable adhesive or bonding tape 227. It is noted that while a double fold end closure 225 is shown in the drawings, the end closure may alternatively comprise a single fold end closure.

The second outer composite bag 224 is formed from two sets of paper plies 240,240 disposed upon opposite sides of the first inner composite bag 219 such that the first inner composite bag 219 is interposed between the two sets 240, 240 of paper plies. It is appreciated that the two sets of papers plies 240,240 are longitudinally offset with respect to each other, or alternatively, that one of the sets of paper plies 240 is longitudinally offset with respect to the other set of paper plies 240 and the first inner composite bag 219, such that longitudinally extending overhanging flap members 242 are formed at each end of the dunnage air bag 210, although only one end of the bag 210 is illustrated in FIG. 5. Each flap member 242 extends longitudinally beyonds its associated side or surface of the first inner composite bag 219 so as to, in effect, have an overhanging longitudinal extent of approximately four inches.

Each set 240 of paper plies is seen to comprise, for example, six paper plies 243–248, and it is seen that the innermost paper ply 243, that is, the paper ply of each paper ply set 240 which is disposed adjacent to and in contact with the first inner composite bag 219, is adhesively bonded by means of, for example, cold glue beads 250 to the next adjacent outer paper ply 244. In a similar manner, the outermost paper ply 248, that is, the paper ply of each paper ply set 240 which is disposed most remote from the first inner composite bag 219, is adhesively bonded by means of, for example, cold glue beads 252 to the next adjacent outer paper ply 247.

It is noted that the longitudinal extent of the cold glue beads 250 and 252 which are disposed upon each end of each set 240 of paper plies which does not constitute or form a flap member 242 is shorter than the longitudinal extent of the cold glue beads 250 and 252 which are disposed upon each end of each set 240 of paper plies which does constitute or form a flap member 242 simply because each flap member 242 must have an extended length or overlapping extent so as to in fact be able to be folded over the corresponding or associated end of the other set 240 of paper plies, which does not constitute the flap member 242, so as to be able to be properly and securely bonded thereto. In particular, the shorter longitudinal extents of the cold glue beads 250 and 252 may comprise a length dimension of, for example, six inches, while the longer longitudinal extents of the cold glue beads 250 and 252 may comprise a length dimension of, for example, ten inches. As previously noted, each flap member 242 may therefore have a longitudinal extent comprising a length dimension of approximately four inches, and it is noted that the cold glue beads 250 and 252 are transversely spaced with respect to each other by means of a distance which may be, for example, four inches.

When it is desired to in fact form the closed end sealed dunnage bag 210 from the component parts thereof comprising the first inner inflatable composite bag 219 and the two sets 240,240 of paper plies comprising, in effect, the second outer composite bag 224, each flap members 242 of the two sets 240,240 of paper plies are folded, for example, downwardly as illustrated in FIG. 5 with respect to the right side or end of the dunnage air bag 210, as designated by the arrow D, such that the flap member 242 respectively overlaps the associated or corresponding end portion of the sets 240,240 of the paper plies which does not constitute the flap members 242.

In order to secure each folded flap member 242 to the associated non-flap end portion of the other set 240 of paper plies, each flap member 242 is respectively bonded to such associated non-flap end portion of the other set 240 of paper plies by means of a bonding arrangement or technique which comprises bonding the surface portion of paper ply 243 which forms a part of the flap member 242 to the non-flap end portion of paper ply 248 of the other set 240 of paper plies by means of a predeterminedly arranged series of hot melt adhesive beads H and cold glue beads C, as denoted by the reference character 253, which are disposed or extend transversely with respect to or across the longitudinal extent of the dunnage air bag 210 so as to be disposed perpendicular to the longitudinal extents of cold glue beads 250. In addition to such bonding arrangement 253 comprising hot melt adhesive beads H and cold glue beads C, suitable tape 254 may be disposed over the closed and sealed flap member 242, and the tape 254 may be secured to the flap end portion of outer paper ply 248 by means of a suitable combination of hot melt adhesive beads H and cold glue beads C as disclosed at 256, and similarly, the tape 254 may be secured to the outer surface portion of the outer paper ply 248 of the other set 240 of paper plies, to which the flap member 242 is secured, by means of another pattern of hot melt adhesive beads H and cold glue beads C as disclosed at 258. An intermediate portion of the tape 254 may also be secured to the flap end structure 232 of the flap member 242 by means of a single bead of hot melt adhesive H as shown at 260.

In accordance then with the specific teachings and principles of the present invention, in connection with the dunnage air bag 210 illustrated in FIG. 5, the region at which the folded and glued flap end structure 232 is formed comprises a high stress region 234. Consequently, in order to eliminate any additional or further stresses within such area or region 234, or considered alternatively, in order not to develop any additional weakness within such region 234, the inflation valve 220 for the dunnage air bag 210 is relocated from within the vicinity of the high stress flap end region 234, which is adjacent to the folded and glued flap end structure 232 and which is disposed upon a first or lower side of the dunnage air bag 210 as viewed in FIG. 5, to a location 236 which is remote from such high stress flap end region 234 and which is located upon a second or upper side of the dunnage air bag 210.

As was the case with the dunnage air bags 10 and 110 illustrated in FIGS. 1 and 4, the inflation valve 220 is fixedly mounted upon the inflatable bladder 222 so as to be in fluidic communication with the interior of the bladder 222, and the paper plies 221, 223, and 243–248 of the upper set 240 of paper plies, as viewed in FIG. 5, are respectively provided with suitable apertures or holes 1C–8C through which the inflation valve 220 projects such that the inflation valve 220 is accessible externally of the dunnage air bag 210 whereby the dunnage air bag 210 can be readily inflated by operator personnel.

In view of the fact that the inflation valve 220 is located relatively remote from the folded and glued flap end structure 232 and the high stress region or area 234, the relatively weakened areas of the paper plies 243–248, as defined or determined by means of the holes or apertures 3C–8C provided therein, do not contribute further or additional weakening forces or stresses to the high stress region 234 whereby it has been determined that increased or enhanced burst strength characteristics are in fact exhibited by a dunnage bag having the structural makeup as illustrated in connection with the dunnage air bag 210.

It is also to be noted in connection with the dunnage air bag embodiment 210 of FIG. 5 that the bag 210 differs from, for example, the dunnage air bag 110 illustrated in FIG. 4 in that the end flap structure of the dunnage air bag 110 of FIG. 4 is, as has been noted, of the manually tucked-in type wherein, for example, the paper ply ends 2A,3A, and 4A are inserted under or tucked-in beneath the paper ply end 4B, whereas the end flap structure of the dunnage air bag 210 of FIG. 5 is of the type which is advantageously capable of being fabricated by automated machinery wherein the flap member or end 242 is disposed externally of paper ply 248. However, the flap member 242 is secured by bonding arrangements 253 and 256 comprising the noted hot adhesive and cold glue beads, as well as by tape 254. In view of such bonding arrangements, and in view of the need for additional surface contact area to be defined between the flap member 242 and the paper ply 248, it has been determined that enhanced burst strength characteristics are achieved if the flap members 242 have a length of, for example, four inches (4") as opposed to three inches (3") which is an exemplary flap length which may be used in connection with the dunnage air bag 110 of FIG. 4. The additional length provided for the flap members 242 would therefore present logistics or location problems with respect to valve 220 as has been noted hereinbefore, however, in view of the fact that the valve 220 has been, in effect, relocated in accordance with the principles and teachings of the present invention, flap members 242, having their increased length dimensions, may be advantageously employed.

Figure 2:
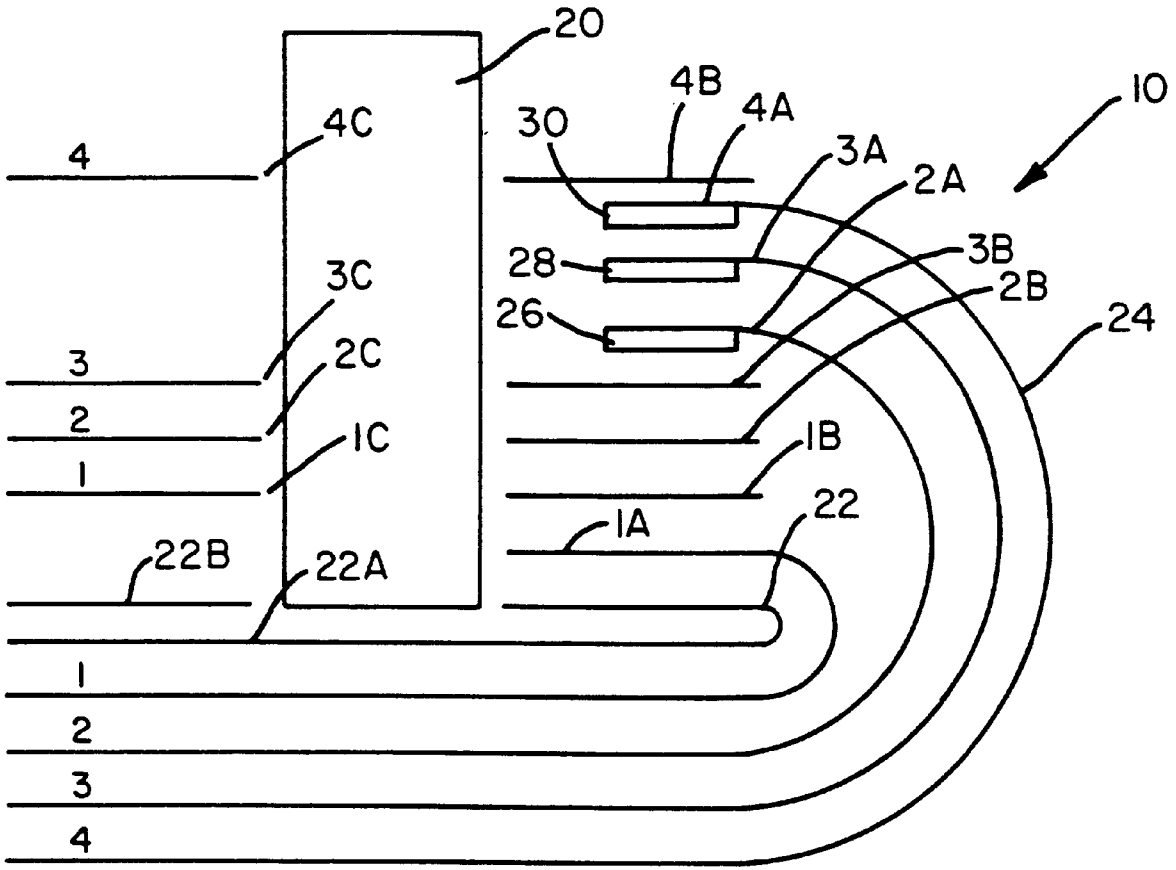
FIG. 2 PRIOR ART
FIG. 2 is schematic, cross-sectional view of a conventional dunnage air bag showing the relative location or disposition of the inflation valve relative to the folded and glued flap end structure and region thereof.
Figure 3:
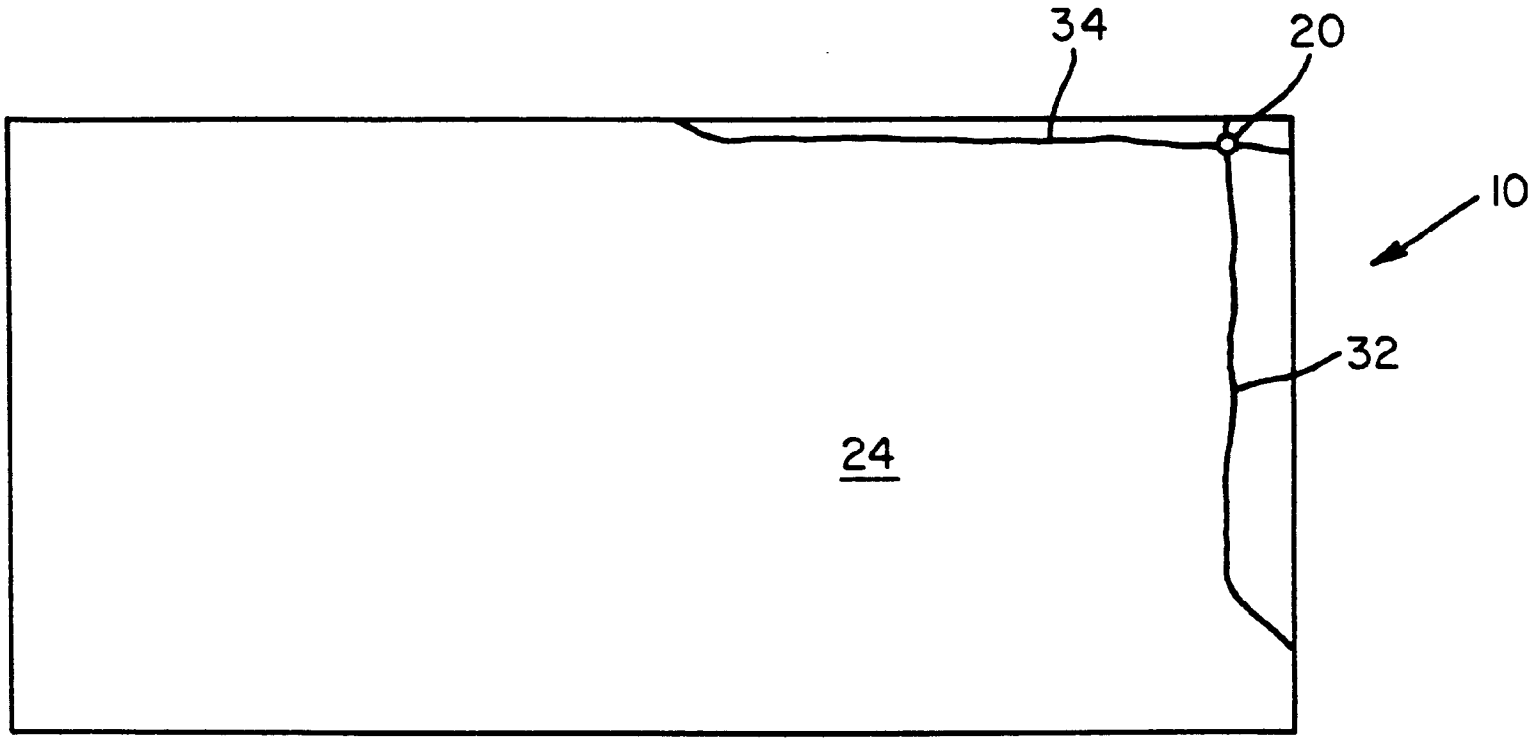
FIG. 3 is a side elevation view schematically illustrating the bursting pattern of a dunnage air bag when subjected to bursting pressures or stresses.

The following test data demonstrates the aforenoted increased or enhanced burst strength characteristics or values of dunnage air bags when constructed in accordance with the teachings and principles of the present invention as illustrated, for example, in FIG. 4, and when compared to conventional dunnage air bags, such as, for example, the dunnage air bag 10 illustrated in FIG. 2, the 1997 results being with respect to the new and improved dunnage bag of FIG. 4 while the 1996 results relate to the conventional dunnage bag of FIG. 2;

| TEST DATE | TYPE OF BAG | BURST STRENGTH (PSI) |
|---|---|---|
| Quarter | 400 | 21.17 |
| Ending 3-31-97 | 600 | 31.25 |
| | 800 | 40.83 |
| Quarter | 400 | 18.46 |
| Ending 3-31-96 | 600 | 26.85 |
| | 800 | 34.45 |
| Quarter | 400 | 17.11 |
| Ending 6-30-96 | 600 | 28.83 |
| | 800 | 34.76 |
| Quarter | 400 | 16.88 |
| Ending 9-30-96 | 600 | 27.54 |
| | 800 | 35.92 |
| Quarter | 400 | 19.81 |
| Ending 12-31-96 | 600 | 29.46 |
| | 800 | 36.80 |

In connection with the above test data results, it is noted that the type of dunnage air bag designated 400 comprises a four-ply paper bag such as that shown in FIGS. 2 and 4, the dunnage air bag designated 600 comprises a six-ply paper bag, not actually illustrated, and the dunnage air bag designated 800 comprises an eight-ply paper bag, not actually illustrated but similar in construction to those dunnage bags illustrated in FIGS. 2 and 4. All test data recorded in connection with testing performed in 1996 were derived from tests conducted upon conventional dunnage air bags, such as, for example, that illustrated in FIG. 2 wherein the inflation valve 20 is disposed within the vicinity of the high stress region, whereas the test data recorded in connection with testing performed in 1997 were derived from tests conducted upon dunnage air bags constructed in accordance with the teachings and principles of the present invention and as illustrated in FIG. 4, As can be appreciated, all of the 400 type conventional dunnage air bags tested in 1996 had an average burst strength of 18.07 psi, all of the 600 type conventional dunnage air bags tested in 1996 had an average burst strength of 28.17 psi, and all of the 800 type conventional dunnage air bags tested in 1996 had an average burst strength of 35.48 psi. When compared with the burst strengths of the dunnage air bags constructed in accordance with the principles and teachings of the present invention, such as of the construction type shown in FIG. 4, wherein the 400 type dunnage air bag had a burst strength value of 21.17, the 600 type dunnage air bag had a burst strength value of 31.25, and the 800 type dunnage air bag had a burst strength value of 40.83, the burst strength values of the dunnage air bags constructed in accordance with the teachings and principles of the present invention exhibited a percentage increase of 17.16%, 10.89%, and 15.08%, respectively, Thus, it may be appreciated that in accordance with the various teachings and principles of the present invention, a new and improved dunnage air bag exhibiting increased or enhanced burst strength values has been developed. Alternatively, if desired, conventionally acceptable burst strength values may be achieved by means of dunnage air bags constructed in accordance with the teachings and principles of the present invention, but one or more of the paper plies comprising the dunnage air bag may be eliminated whereby the total number of paper plies comprising the dunnage air bag required to fabricate or manufacture the dunnage air bag may be reduced with a concomitant reduction in manufacturing or fabrication costs. It is also noted that when the inflation valve 220 is disposed at its new location site 236, the valve 220 is still located close enough to the folded and glued end of the dunnage air bag 210 so as to be readily externally accessible to operator personnel when inflation of the dunnage air bag 210 in connection with cargo loads is to be performed.

Obviously, many modifications and variations of the present invention are possible in light of the above teachings. It is therefore to be understood that within the scope of the appended claims, the present invention may be practiced otherwise than as specifically described herein.

What is claimed is:

1. A method of forming an inflatable dunnage bag, comprising the steps of:

providing an air-tight inflatable bladder;

providing first and second sets of paper plies, wherein each one of said first and second sets of paper plies comprises a plurality of paper plies;

disposing said first and second sets of paper plies upon opposite sides of said air-tight inflatable bladder;

longitudinally offsetting said first and second sets of paper plies such that at least one flap member is formed at one end of a first one of said first and second sets of paper plies and projects beyond one end of a second one of said first and second sets of paper plies;

folding said at least one flap member over said air-tight inflatable bladder so as to thereby extend from a first side of said air-tight inflatable bladder to a second side of said air-tight inflatable bladder and be secured to at least one of said paper plies comprising said second one of said first and second sets of paper plies;

securing said at least one flap member of said first one of said first and second sets of paper plies to a region of said at least one of said paper plies comprising said second one of said first and second sets of paper plies which is disposed upon said second side of said air-tight inflatable bladder so as to close and seal said dunnage bag; and fixedly mounting and sealing an inflation means upon said first side of said air-tight inflatable bladder for inflating said air-tight inflatable bladder such that said inflation means is disposed upon the side of said air-tight inflatable bladder which is opposite the side of said air-tight inflatable bladder upon which said at least one flap member is secured to said region of said at least one of said paper plies comprising said second one of said first and second sets of paper plies whereby said inflation means is disposed remote from said region at which said at least one flap member is secured.

2. The method as set forth in claim 1, wherein:

said plurality of paper plies comprising said first and second sets of paper plies comprises four paper plies.

3. The method as set forth in claim 1, wherein:

said plurality of paper plies comprising said first and second sets of paper plies comprises eight paper plies.

4. The method as set forth in claim 1, further comprising the step of:

securing said at least one flap member of said first one of said first and second sets of paper plies between the two outermost paper plies of said second one of said first and second sets of paper plies.

5. The method as set forth in claim 1, further comprising the step of:

securing said at least one flap member of said one of said first and second sets of paper plies to an outer surface portion of the outermost paper ply of said second one of said first and second sets of paper plies.

6. The method as set forth in claim 1, further comprising the step of:

forming aperture means within said paper plies comprising said first one of said first and second sets of paper plies for permitting said bladder inflation means to project outwardly from said air-tight inflatable bladder and through said paper plies comprising said first one of said first and second sets of paper plies so as to be accessible externally of said inflatable dunnage bag.

7. A method of forming an inflatable dunnage bag, comprising the steps of:

providing an air-tight inflatable bladder;

providing first and second sets of paper plies, wherein each one of said first and second sets of paper plies comprises a plurality of paper plies;

disposing said first and second sets of paper plies upon opposite sides of said air-tight inflatable bladder;

longitudinally offsetting said first and second sets of paper plies such that at least one flap member is formed at one end of a first one of said first and second sets of paper plies and projects beyond one end of a second one of said first and second sets of paper plies;

folding said at least one flap member over said air-tight inflatable bladder and said one end of said second one of said first and second sets of paper plies so as to thereby extend from a first side of said air-tight inflatable bladder to a second side of said air-tight inflatable bladder and be secured to at least one of said paper plies comprising said second one of said first and second sets of paper plies;

securing said at least one flap member of said first one of said first and second sets of paper plies to a region of said at least one of said paper plies comprising said second one of said first and second sets of paper plies which is disposed upon said second side of said air-tight inflatable bladder so as to close and seal said dunnage bag; and fixedly mounting and sealing an inflation means upon said first side of said air-tight inflatable bladder for inflating said air-tight inflatable bladder such that said inflation means is disposed upon the side of said air-tight inflatable bladder which is opposite the side of said air-tight inflatable bladder upon which said at least one flap member is secured to said region of said at least one of said paper plies comprising said second one of said first and second sets of paper plies whereby said inflation means is disposed remote from said region at which said at least one flap member is secured.

8. The method as set forth in claim 7, wherein:

said plurality of paper plies comprising said first and second sets of paper plies comprises four paper plies.

9. The method as set forth in claim 7, wherein:

said plurality of paper plies comprising said first and second sets of paper plies comprises eight paper plies.

10. The method as set forth in claim 7, further comprising the step of:

securing said at least one flap member of said first one of said first and second sets of paper plies between the two outermost paper plies of said second one of said first and second sets of paper plies.

11. The method as set forth in claim 7, further comprising the step of:

securing said at least one flap member of said one of said first and second sets of paper plies to an outer surface portion of the outermost paper ply of said second one of said first and second sets of paper plies.

12. The method as set forth in claim 7, further comprising the step of:

forming aperture means within said paper plies comprising said first one of said first and second sets of paper plies for permitting said bladder inflation means to project outwardly from said air-tight inflatable bladder and through siad paper plies comprising said first one of said first and second sets of paper plies so as to be accessible externally of said inflatable dunnage bag.

13. The method as set forth in claim 1, further comprising the step of:

forming said at least one flap member such that said at least one flap member has a length of approximately three inches.

14. The method as set forth in claim 7, further comprising the step of:

forming said at least one flap member such that said at least one flap member has a length of approximately three inches.

15. The method as set forth in claim 1, further comprising the step of:

forming said at least one flap member such that said at least one flap member has a length of approximately four inches.

16. The method as set forth in claim 7, further comprising the step of:

forming said at least one flap member such that said at least one flap member has a length of approximately four inches.

17. The method as set forth in claim 5, wherein the step of securing said at least one flap member of said one of said first and second sets of paper plies to said outer surface portion of said outermost paper ply of said second one of said first and second sets of paper plies comprises the step of:

securing said at least one flap member of said one of said first and second sets of paper plies to said outer surface portion of said outermost paper ply of said second one of said first and second sets of paper plies by using a combination of hot melt adhesive beads and cold glue beads.

18. The method as set forth in claim 11, wherein the step of securing said at least one flap member of said one of said first and second sets of paper plies to said outer surface portion of said outermost paper ply of said second one of said first and second sets of paper plies comprises the step of:

securing said at least one flap member of said one of said first and second sets of paper plies to said outer surface portion of said outermost paper ply of said second one of said first and second sets of paper plies by using a combination of hot melt adhesive beads and cold glue beads.

19. The method as set forth in claim 5, wherein the step of securing said at least one flap member of said one of said first and second sets of paper plies to said outer surface portion of said outermost paper ply of said second one of said first and second sets of paper plies comprises the step of:

securing said at least one flap member of said one of said first and second sets of paper plies to said outer surface portion of said outermost paper ply of said second one of said first and second sets of paper plies by using a tape bonded to an outer surface portion of said at least one flap member and said outer surface portion of said outermost paper ply of said second one of said first and second sets of paper plies.

20. The method as set forth in claim 7, wherein the step of securing said at least one flap member of said one of said first and second sets of paper plies to said outer surface portion of said outermost paper ply of said second one of said first and second sets of paper plies comprises the step of:

securing said at least one flap member of said one of said first and second sets of paper plies to said outer surface portion of said outermost paper ply of said second one of said first and second sets of paper plies by using a tape bonded to an outer surface portion of said at least one flap member and said outer surface portion of said outermost paper ply of said second one of said first and second sets of paper plies.

21. The method as set forth in claim 19, wherein the step of securing said at least one flap member of said one of said first and second sets of paper plies to said outer surface portion of said outermost paper ply of said second one of said first and second sets of paper plies comprises the step of:

securing said tape to said outer surface portion of said at least one flap member and to said outer surface portion of said outermost paper ply of said second one of said first and second sets of paper plies by using a combination of hot melt adhesive beads and cold glue beads.

22. The method as set forth in claim 20, wherein the step of securing said at least one flap member of said one of said first and second sets of paper plies to said outer surface portion of said outermost paper ply of said second one of said first and second sets of paper plies comprises the step of:

securing said tape to said outer surface portion of said at least one flap member and to said outer surface portion of said outermost paper ply of said second one of said first and second sets of paper plies by using a combination of hot melt adhesive beads and cold glue beads.

* * * * *